US011203101B1

(12) United States Patent
Chan

(10) Patent No.: US 11,203,101 B1
(45) Date of Patent: Dec. 21, 2021

(54) TORQUE STRUCTURE

(71) Applicant: Fu-Yi Chan, Taichung (TW)

(72) Inventor: Fu-Yi Chan, Taichung (TW)

( * ) Notice: Subject to any disclaimer, the term of this patent is extended or adjusted under 35 U.S.C. 154(b) by 0 days.

(21) Appl. No.: 17/183,520

(22) Filed: Feb. 24, 2021

(51) Int. Cl.
*B25B 23/142* (2006.01)

(52) U.S. Cl.
CPC ..... *B25B 23/1427* (2013.01)

(58) Field of Classification Search
CPC ..... B25B 23/1427
USPC ..... 81/480–483, 475–478
See application file for complete search history.

(56) References Cited

U.S. PATENT DOCUMENTS 5,503,042 A 4/1996 Larson et al.
2021/0213592 A1* 7/2021 Kuo ..... B25B 23/1427

* cited by examiner

*Primary Examiner* — Orlando E Aviles
*Assistant Examiner* — Sarah Akyaa Fordjour
(74) *Attorney, Agent, or Firm* — Karin L. Williams; Alan D. Kamrath; Mayer & Williams PC

(57) ABSTRACT

A torque structure includes a first body set, and a second body set. The second body set has a torque slip function. The second body set includes a second body, a drive head, a resisting module, a plurality of balls, and a mounting ring. The second body is provided with a third receiving recess and a plurality of ball slots. The drive head is connected with the second body. The resisting module is received in the third receiving recess and includes a first abutting element. The mounting ring is mounted on the second body and has an interior provided with a fourth receiving recess. The balls are received in the ball slots and located between the first abutting element and the fourth receiving recess.

10 Claims, 17 Drawing Sheets

A-A

B-B

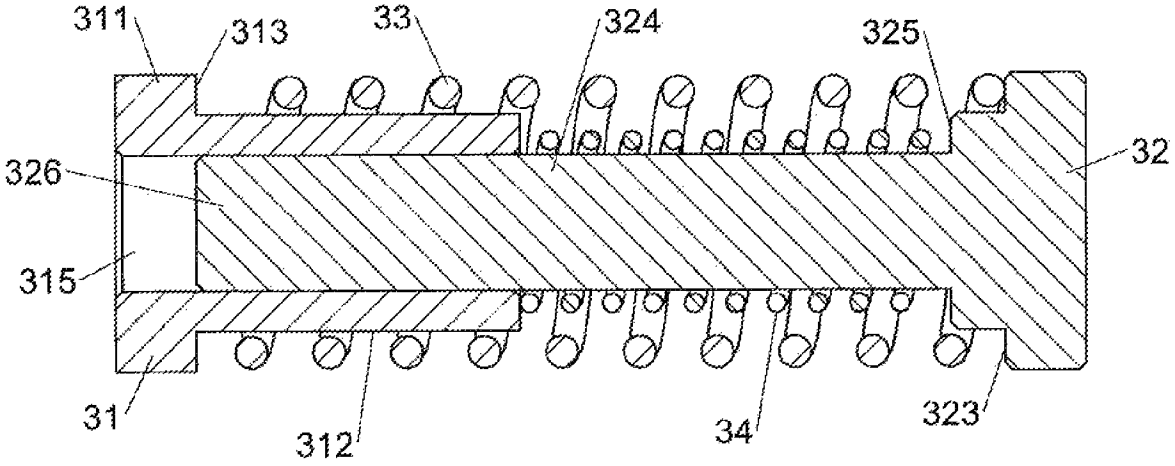
B-B FIG. 10

C-C

TORQUE STRUCTURE

BACKGROUND OF THE INVENTION

1. Field of the Invention

The present invention relates to a hand tool and, more particularly, to a torque structure.

2. Description of the Related Art

A conventional hand tool 10 was disclosed in the U.S. Pat. No. 5,503,042, and comprises a drive head 11 with a drive member 12. The head 11 is connected by means of a swivel knuckle 14 to the proximal, clevis head end of a force transmitting elongate rod-like member 15 extending longitudinally in a tubular case or housing 17 which is attached rockably at one end by means of a pin 18 to the force transmission member 15. The tubular housing 17 has on its outer perimeter an incremented scale 19 adjacent to a thimble 20 attached to a lock ring retainer 21 with which is associated a lock ring 22 at the proximal end of a handle 23. Within the handle 23 is a coil compression biasing spring 24 which has an inner end thrusting against a balance cam 25. Within a socket 27 in the balance cam 25 is assembled a complementary elongate stem or boss 28 of a plunger 29 equipped with antifriction side thrust rollers 30.

However, the conventional hand tool 10 has the following disadvantages.

1. The thrust rollers 30 are received in the balance cam 25 and rest on an inner face of the tubular housing 17. The thrust rollers 30 are restricted by the inner diameter of the tubular housing 17 and the outer diameter of the balance cam 25 so that the diameter of each of the thrust rollers 30 is limited, thereby reducing the antifriction rolling effect of the thrust rollers 30.

2. The conventional hand tool 10 only has two thrust rollers 30 so that a point contact structure is defined between each of the thrust rollers 30 and the tubular housing 17.

3. The thrust rollers 30 are initially assembled with the balance cam 25. Then, the thrust rollers 30 and the balance cam 25 are placed into the tubular housing 17. The thrust rollers 30 and the balance cam 25 have to slide and move through a determined distance before being assembled in the tubular housing 17. Thus, the thrust rollers 30 and the balance cam 25 are easily detached during sliding, so that the thrust rollers 30 are dropped into the tubular housing 17. It is necessary to take out the thrust rollers 30 and the balance cam 25 for reassembly, thereby causing inconvenience to the operator.

BRIEF SUMMARY OF THE INVENTION

In accordance with the present invention, there is provided a torque structure comprising a first body set, and a second body set. The second body set has a torque slip function. The second body set includes a second body, a drive head, a resisting module, a plurality of balls, and a mounting ring. The second body is provided with a third receiving recess and a plurality of ball slots. The drive head is connected with the second body. The resisting module is received in the third receiving recess and includes a first abutting element. The mounting ring is mounted on the second body and has an interior provided with a fourth receiving recess. The balls are received in the ball slots and located between the first abutting element and the fourth receiving recess.

According to the primary advantage of the present invention, the mounting ring is mounted on the second body and has a diameter more than that of the second body. The balls protrude from the ball slots and are hidden in the mounting ring so that each of the balls has a larger diameter due to the larger diameter of the mounting ring. Thus, when the balls are located between the resisting module and the mounting ring, the balls have better rolling effect when the resisting module is moved in the third receiving recess.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

FIG. 10 is a schematic operational view of the elastic member set as shown in FIG. 9.

DETAILED DESCRIPTION OF THE INVENTION

Figure 1:
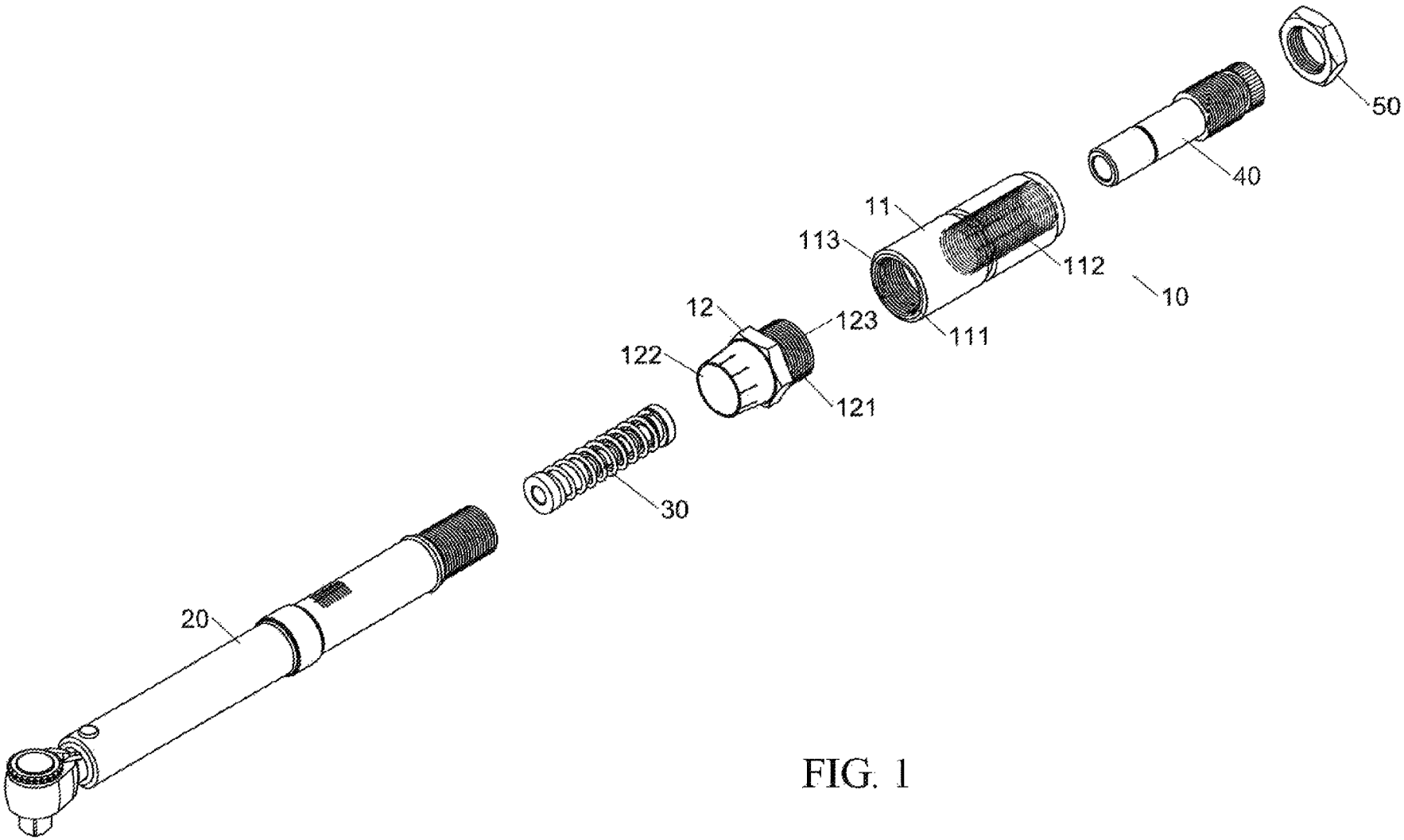
FIG. 1 is an exploded perspective view of a torque structure in accordance with the preferred embodiment of the present invention.

Referring to the drawings and initially to FIGS. 1-19, a torque structure in accordance with the preferred embodiment of the present invention comprises a first body set 10, a second body set 20, and an elastic member set 30.

The first body set 10 includes a first body 11 and a fitting member 12.

The first body 11 is a rod that is held and rotated by the user. The first body 11 has an interior provided with a first receiving recess 111. The first receiving recess 111 has a circular shape and extends through the first body 11. The first receiving recess 111 has a first end provided with a first screwed portion 112 and a second end provided with a second screwed portion 113 opposite to the first screwed portion 112. Each of the first screwed portion 112 and the second screwed portion 113 is an internal thread. The second screwed portion 113 has a diameter more than that of the first screwed portion 112. The exterior of the first body 11 may be provided with a knurling or a handle to facilitate the user holding the first body 11.

The fitting member 12 has a cylindrical shape and is assembled with the first body 11. The fitting member 12 has a peripheral face provided with a third screwed portion 121 screwed with the second screwed portion 113 so that the fitting member 12 is combined and rotated with the first body 11. The third screwed portion 121 is an external thread. The fitting member 12 has an interior provided with a second receiving recess 122 having a circular shape and extending through the fitting member 12. The second receiving recess 122 is connected to the first receiving recess 111. The third screwed portion 121 has an end provided with a first abutting portion 123 hidden in the first receiving recess 111. The first abutting portion 123 has a planar shape and is directed toward the first screwed portion 112.

The second body set 20 is assembled or connected with the first body set 10. The second body set 20 has a torque slip (or escape or limit) function so that when the torque applied on the first body set 10 exceeds a predetermined value, the second body set 20 slips and escapes automatically. The second body set 20 includes a second body 21, a drive head 22, a resisting (or resting or driven) module 23, a restriction member 24, a first ring 25, a plurality of balls 26, a mounting ring 28, and two second rings 29.

The second body 21 is pivotally connected with the first body set 10. The second body 21 is partially received in the first receiving recess 111 and extends through the second receiving recess 122. The second body 21 has an interior provided with a third receiving recess 211 having a circular shape and extending through the second body 21. The third receiving recess 211 is connected to the first receiving recess 111. The second body 21 has a first end provided with a fourth screwed portion 212 screwed with the first screwed portion 112. The fourth screwed portion 212 is an external thread. The first screwed portion 112 is rotated and moved on the fourth screwed portion 212 so that the first body set 10 is rotated and moved relative to the second body 21. The second body 21 has an inner face provided with a first limit groove 213 connected to the third receiving recess 211. The first limit groove 213 has a semicircular shape and is arranged on an inner face of the fourth screwed portion 212. The second body 21 is provided with a first annular groove 214 arranged on one end of the fourth screwed portion 212 and hidden in the first receiving recess 111. The second body 21 is provided with a plurality of ball slots 215 connected to the third receiving recess 211. The second body 21 is provided with two second annular grooves 216. The ball slots 215 are arranged between the two second annular grooves 216. One of the two second annular grooves 216 is arranged between the first annular groove 214 and the ball slots 215.

The drive head 22 is pivotally connected with a second end of the second body 21. The drive head 22 protrudes from the second body 21 and is opposite to the first body 11 of the first body set 10.

The resisting module 23 is received in the third receiving recess 211 and includes a first abutting element 231. The first abutting element 231 is provided with a plurality of first channels 2311 aligning with the ball slots 215. The first channels 2311 have a number corresponding to that of the ball slots 215. The first channels 2311 are arranged annularly along an axis of the first abutting element 231. Each of the first channels 2311 has an elongate arcuate shape.

The restriction member 24 is received in the first limit groove 213 and partially protrudes from the third receiving recess 211. The restriction member 24 has a ball shape corresponding to that of the first limit groove 213.

The first ring 25 is mounted in and partially protrudes from the first annular groove 214. The first ring 25 aligns with the first abutting portion 123. When the first body set 10 is rotated and moved relative to the second body set 20, the first abutting portion 123 is restricted by the first ring 25 so that the first body set 10 cannot be detached from the second body set 20. When the first abutting portion 123 approaches the first ring 25, the torque value of the torque structure approaches the minimum.

The balls 26 are received in the ball slots 215. Each of the ball slots 215 receives at least one of the balls 26. The balls 26 partially extend into the first channels 2311 and partially protrude from the second body 21.

The mounting ring 28 is mounted on the second body 21 and has an interior provided with a fourth receiving recess 281 allowing passage of the second body 21. The fourth receiving recess 281 has a circular shape and extends through the mounting ring 28. The ball slots 215 are hidden in the fourth receiving recess 281. The fourth receiving recess 281 has an inner face provided with a plurality of second channels 282 aligning with the ball slots 215. The balls 26 are located between the first channels 2311 and the second channels 282. A linear contact structure is defined between the balls 26, the first channels 2311, and the second channels 282. The second channels 282 have a number corresponding to that of the ball slots 215. The second channels 282 are arranged annularly along an axis of the mounting ring 28. Each of the second channels 282 has an elongate arcuate shape.

The two second rings 29 are mounted in and partially protrude from the two second annular grooves 216. The mounting ring 28 is located between the two second rings 29 so that the mounting ring 28 cannot be detached from the second body 21.

The elastic member set 30 is received in the third receiving recess 211 and directly or indirectly pushes the resisting module 23 so that the second body set 20 has a torque slip function. The elastic member set 30 includes a first push member 31, a second push member 32, a first elastic member 33, and a second elastic member 34.

The first push member 31 is received in the third receiving recess 211 and has a first end provided with a first head 311 and a second end provided with a first mounting portion 312. The first head 311 has a circular shape and directly or indirectly pushes the resisting module 23. The first mounting portion 312 has a circular shape with a diameter less than that of the first head 311. The first push member 31 has a first resting edge 313 formed between the first head 311 and the first mounting portion 312. The first mounting portion 312 has an end provided with a second resting edge 314. The first mounting portion 312 is arranged between the first resting edge 313 and the second resting edge 314. The first push member 31 has an interior provided with a second mounting portion 315.

The second push member 32 is received in the third receiving recess 211 and aligns with the first push member 31. The second push member 32 has an end provided with a second head 321 having a circular shape. The second head 321 has an end provided with a third mounting portion 322 having a circular shape with a diameter equal to that of the first mounting portion 312 and less than that of the second head 321. The second push member 32 has a third resting edge 323 formed between the second head 321 and the third mounting portion 322. The third mounting portion 322 has an end provided with a fourth mounting portion 324 having a diameter less than that of the third mounting portion 322. The third mounting portion 322 is arranged between the second head 321 and the fourth mounting portion 324. The second push member 32 has a fourth resting edge 325 formed between the third mounting portion 322 and the fourth mounting portion 324. The fourth mounting portion 324 has a first end 326 received in the second mounting portion 315 when the first head 311 and the second head 321 have the maximum distance therebetween.

The first elastic member 33 is received in the third receiving recess 211 and biased between the first push member 31 and the second push member 32. The first elastic member 33 is mounted on the first mounting portion 312, the third mounting portion 322, and the fourth mounting portion 324. The first elastic member 33 has a first end provided with a first elastic portion 331 abutting the first resting edge 313 and a second end provided with a second elastic portion 332 abutting the third resting edge 323. The first elastic member 33 has a first diameter differential 333 that is a difference between the maximum diameter and the minimum diameter of the first elastic member 33.

The second elastic member 34 is received in the third receiving recess 211 and biased between the first push member 31 and the second push member 32. The second elastic member 34 is received in the first elastic member 33. The maximum diameter of the second elastic member 34 is less than the minimum diameter of the first elastic member 33. The second elastic member 34 is mounted on the fourth mounting portion 324. The second elastic member 34 has a first end provided with a third elastic portion 341 abutting the second resting edge 314 and a second end provided with a fourth elastic portion 342 abutting the fourth resting edge 325. The second elastic member 34 has a second diameter differential 343 that is a difference between the maximum diameter and the minimum diameter of the second elastic member 34. The second diameter differential 343 is less than the first diameter differential 333.

In practice, when the second push member 32 is driven and moved relative to the first push member 31, the second head 321 is moved relative to the first head 311, and the fourth mounting portion 324 is moved in the second mounting portion 315, so that the first push member 31 and the second push member 32 adjust the length of the first elastic member 33 and the second elastic member 34, so as to adjust the torque. The length of the second mounting portion 315 provides the maximum displacement distance of the second push member 32, so that the first end 326 is hidden in the second mounting portion 315 and will not be detached from the first push member 31.

In assembly, the elastic member set 30 is received in the third receiving recess 211. The first head 311 directly or indirectly pushes the resisting module 23. The second push member 32 is assembled with the first push member 31. The fourth mounting portion 324 is mounted and movable in the second mounting portion 315. The first elastic member 33 is mounted on the first mounting portion 312 and the fourth mounting portion 324. The second elastic member 34 is mounted on the fourth mounting portion 324 and biased between the first push member 31 and the second push member 32. The second elastic member 34 is received in the first elastic member 33.

Figure 9:
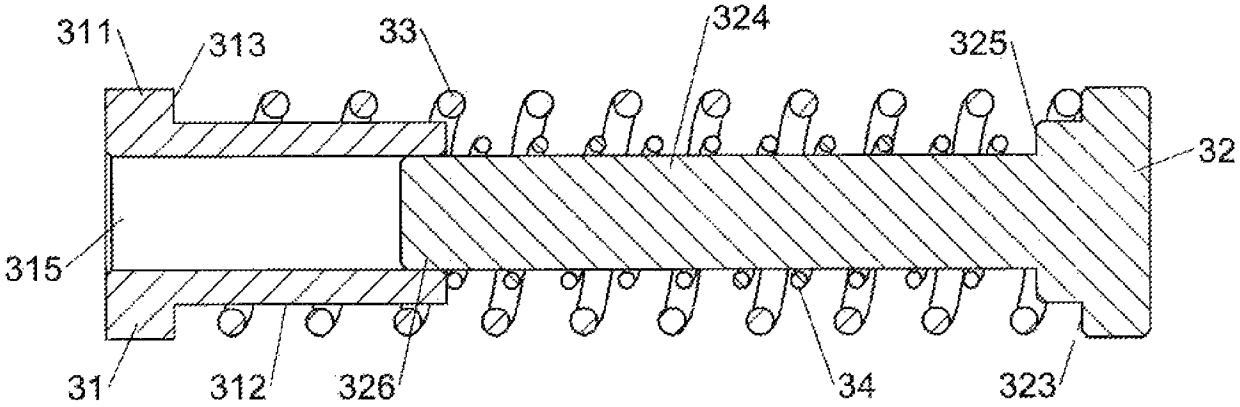
FIG. 9 is a cross-sectional view of the elastic member set taken along line B-B as shown in FIG. 8.
Figure 8:
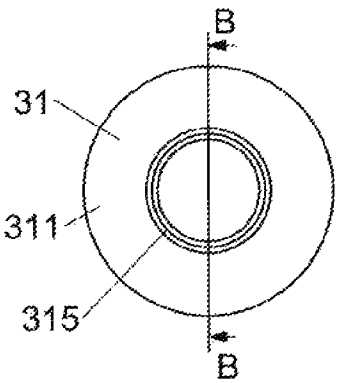
FIG. 8 is a front view of the elastic member set as shown in FIG. 7.
Figure 11:
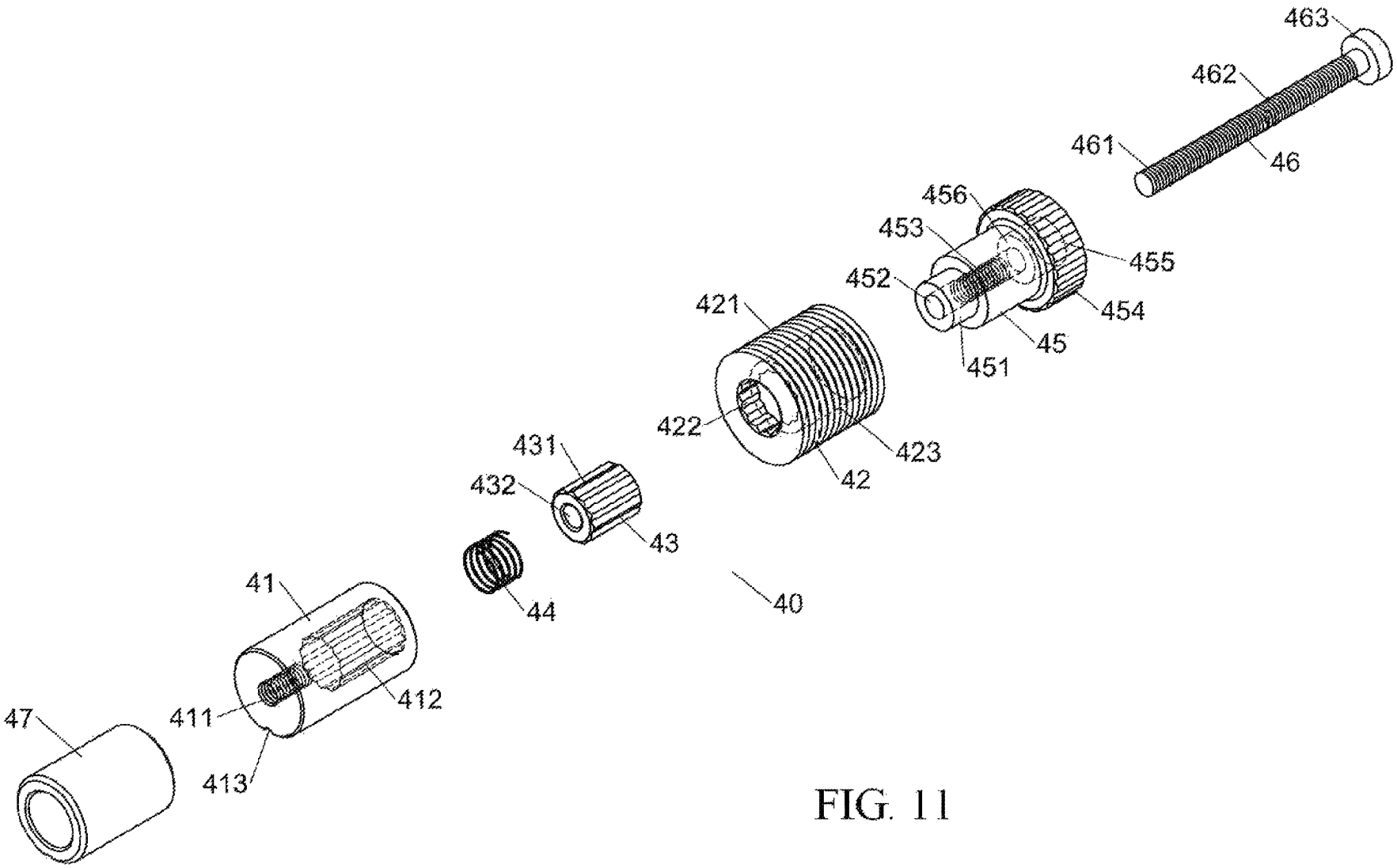
FIG. 11 is an exploded perspective view of a locking set of the torque structure in accordance with the preferred embodiment of the present invention.
Figure 12:
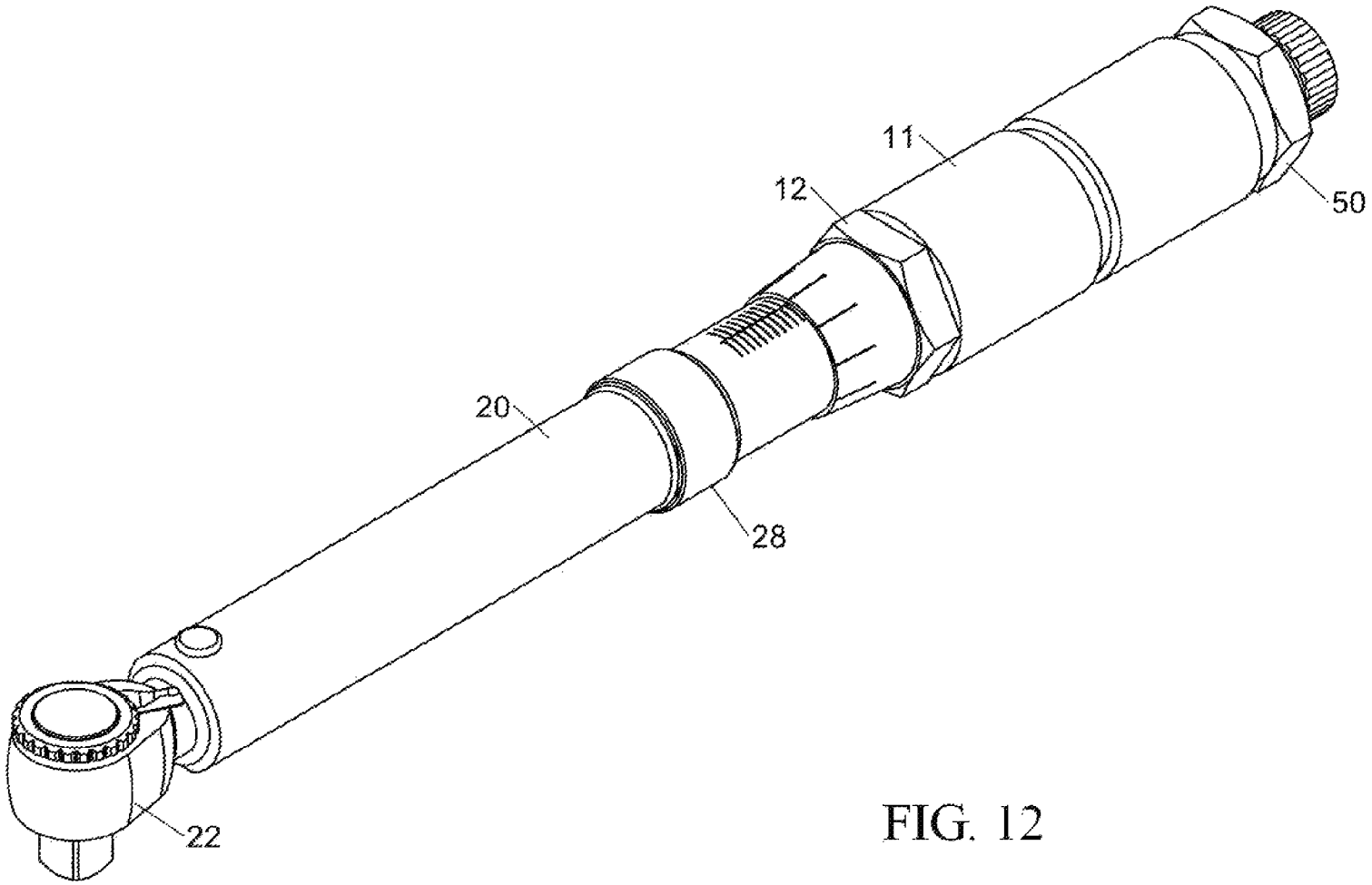
FIG. 12 is a perspective view of the torque structure in accordance with the preferred embodiment of the present invention.
Figure 13:
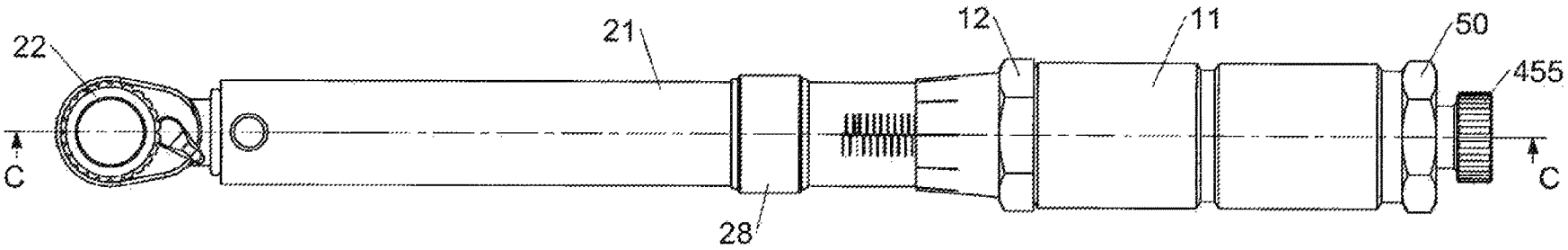
FIG. 13 is a top view of the torque structure as shown in FIG. 12.
Figure 14:
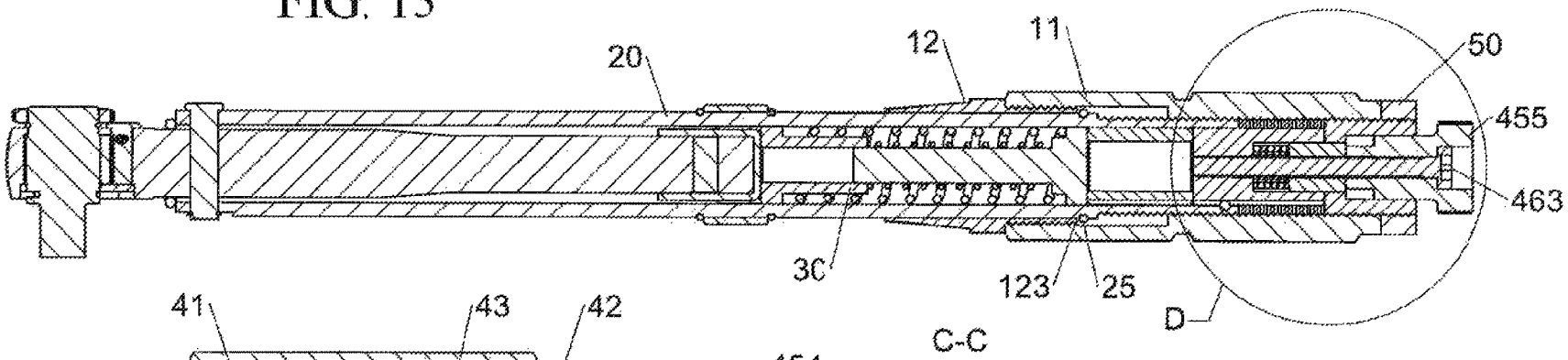
FIG. 14 is a cross-sectional view of the torque structure taken along line C-C as shown in FIG. 13.

When the first body set 10 is rotated and moved relative to the second body set 20, the first body set 10 directly or indirectly drives and moves the second push member 32, so that the fourth mounting portion 324 is moved in the second mounting portion 315, and the third resting edge 323 and the fourth resting edge 325 adjust the length of the first elastic member 33 and the second elastic member 34 as shown in FIGS. 9 and 10, so as to adjust the torque.

In the preferred embodiment of the present invention, each of the ball slots 215 has an elongate shape. The first annular groove 214 is arranged between the fourth screwed portion 212 and the ball slots 215.

In the preferred embodiment of the present invention, the drive head 22 is a ratchet wrench structure with square head, a closed-end wrench or an open-end wrench.

In the preferred embodiment of the present invention, the first abutting element 231 is provided with a first receiving groove 2312 and a second receiving groove 2313. The first receiving groove 2312 has a rectangular shape and is directed toward the drive head 22. The second receiving groove 2313 is arranged between the first channels 2311. The first channels 2311 are symmetric relative to the second receiving groove 2313. The second receiving groove 2313 has an inverted U-shaped profile and has two ends connected to the first receiving groove 2312. The resisting module 23 further includes a second abutting element 232 movably mounted in the first receiving groove 2312, so that the second body 21 has a torque slip function. The resisting module 23 further includes a third abutting element 233 received in the second receiving groove 2313 and having two ends extending into the first receiving groove 2312. The second abutting element 232 is restricted by the two ends of the third abutting element 233 to limit the displacement distance of the second abutting element 232. The third abutting element 233 has an inverted U-shaped profile corresponding to that of the second receiving groove 2313.

In the preferred embodiment of the present invention, each of the ball slots 215 receives two of the balls 26.

In the preferred embodiment of the present invention, each of the ball slots 215 has a conic section connected to the third receiving recess 211, to prevent the balls 26 in the ball slots 215 from dropping into the third receiving recess 211.

In the preferred embodiment of the present invention, the second body set 20 further includes a plurality of springs 27 received in the ball slots 215. The springs 27 are biased between the ball slots 215 and the balls 26 so that the balls 26 are movable in the ball slots 215.

In the preferred embodiment of the present invention, the second mounting portion 315 is a circular recess, and the fourth mounting portion 324 is a circular rod.

In assembly, the drive head 22 is pivotally connected with the second end of the second body 21. The resisting module 23 is received in the third receiving recess 211. The restriction member 24 is received in the first limit groove 213. The first ring 25 is mounted in the first annular groove 214. The balls 26 are received in the ball slots 215. The balls 26 partially extend into the first channels 2311. The springs 27 are received in the ball slots 215 and are biased between the ball slots 215 and the balls 26. The mounting ring 28 is mounted on the second body 21. The ball slots 215 are hidden in the fourth receiving recess 281. The balls 26 are located between the first channels 2311 and the second channels 282. The two second rings 29 are mounted in the two second annular grooves 216.

In the preferred embodiment of the present invention, the torque structure further comprises a locking set 40 assembled with the first body set 10 and the second body set 20. The locking set 40 is changed between an unlocked state wherein the first body set 10 and the second body set 20 are disposed at a pivoting state, and a locked state wherein the first body set 10 and the second body set 20 are disposed at a non-pivoting state. The locking set 40 directly or indirectly presses the elastic member set 30. When the locking set 40 is disposed at the unlocked state, the first body set 10 is rotated and moved relative to the second body set 20, and drives and moves the locking set 40 simultaneously, so that the locking set 40 is moved to directly or indirectly adjust a compression degree of the elastic member set 30 and to adjust the torque of the torque structure.

The locking set 40 includes a first locking member 41, a second locking member 42, a third locking member 43, a third elastic member 44, a fourth locking member 45, a screw member 46, and a third body 47.

The first locking member 41 is received in the first receiving recess 111 and the third receiving recess 211 and has a first end provided with a first threaded portion 411 and a second end provided with a first locking portion 412 connected to the first threaded portion 411. The first threaded portion 411 is an internal thread directed toward the elastic member set 30. The first locking portion 412 is a noncircular or polygonal recess. The first locking portion 412 has a diameter more than that of the first threaded portion 411. The first locking member 41 has an exterior provided with a second limit groove 413 aligning with the first limit groove 213. The second limit groove 413 has an arcuate shape and extends in a lengthwise direction of the first locking member 41. The restriction member 24 is received in between the first limit groove 213 and the second limit groove 413. When the first body set 10 is rotated and moved relative to the second body set 20, the first locking member 41 is limited by the restriction member 24 and is moved linearly.

The second locking member 42 is combined with the first body 11 and rests on the first locking member 41. The second locking member 42 has a peripheral face provided with a fifth screwed portion 421 screwed with the first screwed portion 112. The fifth screwed portion 421 is an external thread and partially protrudes from the first body 11. When the first body set 10 is rotated and moved relative to the second body set 20, the second locking member 42 is rotated by the first body 11 and moved with the first body set 10 by engagement of the fifth screwed portion 421 with the first screwed portion 112, so that the second locking member 42 is rotated and moved relative to the second body set 20 to push the first locking member 41 forward. At this time, the first locking member 41 is limited by the restriction member 24 so that the first locking member 41 is moved linearly and cannot be rotated. The second locking member 42 has a first end provided with a second locking portion 422 and a second end provided with a first receiving chamber 423. The second locking portion 422 aligns with and has a shape corresponding to that of the first locking portion 412. The second locking portion 422 is a noncircular or polygonal recess. The first receiving chamber 423 is a circular recess connected to the second locking portion 422. The first receiving chamber 423 has a diameter more than that of the second locking portion 422.

The third locking member 43 extends through and is movable in the first locking member 41 and the second locking member 42. The third locking member 43 has a peripheral face provided with a third locking portion 431 locked in and meshing with the first locking portion 412 and the second locking portion 422. The third locking portion 431 has a polygonal shape. The third locking member 43 has an interior provided with a first passage 432 having a circular shape and extending through the third locking member 43.

The third elastic member 44 is a spring structure that is received in the first locking portion 412 and biased between a bottom of the first locking portion 412 and the third locking member 43.

The fourth locking member 45 is mounted on the second locking member 42 and has a first end provided with a first receiving portion 451 and a second end provided with a rotation portion 454. The first receiving portion 451 is received in the first receiving chamber 423 and rests on the third locking member 43. When the fourth locking member 45 is moved in the first receiving chamber 423, the first receiving portion 451 pushes the third locking member 43, so that the third locking member 43 is moved in the first locking portion 412 and the second locking portion 422. The first receiving portion 451 is a column and has an interior provided with a second passage 452 aligning with the first passage 432. The second passage 452 has a circular shape and is provided with a second threaded portion 453 that is an internal thread. The rotation portion 454 protrudes from the first body 11 and is opposite to the first receiving portion 451. The rotation portion 454 has an interior provided with a second receiving chamber 455 connected to the second passage 452. The second threaded portion 453 is arranged between the second passage 452 and the second receiving chamber 455. The second receiving chamber 455 has a diameter more than that of the second passage 452. The second receiving chamber 455 has a bottom provided with a second abutting portion 456.

The screw member 46 has a first end provided with a third threaded portion 461 and a fourth threaded portion 462 and a second end provided with a second receiving portion 463. The third threaded portion 461 is screwed with the first threaded portion 411 so that the screw member 46 is secured with the first locking member 41. The fourth threaded portion 462 passes the first passage 432 and the second passage 452 and is screwed with the second threaded portion 453. When the rotation portion 454 is rotated, the second threaded portion 453 is rotated and moved on the fourth threaded portion 462, so that the fourth locking member 45 is rotated and moved in the first receiving chamber 423. The third threaded portion 461 and the fourth threaded portion 462 are connected. Each of the third threaded portion 461 and the fourth threaded portion 462 is an external thread. The second receiving portion 463 is received in the second receiving chamber 455. When the fourth locking member 45 is rotated and moved in the first receiving chamber 423, the second abutting portion 456 contacts or leaves the second receiving portion 463. The fourth threaded portion 462 is arranged between the third threaded portion 461 and the second receiving portion 463. The second receiving portion 463 has a circular shape and has a diameter more than that of the third threaded portion 461 and that of the fourth threaded portion 462. When the fourth locking member 45 is rotated and moved in the first receiving chamber 423, the fourth locking member 45 is restricted by the second receiving portion 463 and will not be detached from the second locking member 42.

The third body 47 is received in the third receiving recess 211 and located between the second push member 32 of the elastic member set 30 and the first locking member 41. When the first locking member 41 is moved to push the third body 47, the third body 47 presses the second push member 32 of the elastic member set 30 to adjust the torque of the torque structure.

The first locking member 41 can only be moved linearly. The second locking member 42 can be rotated and moved.

When the fourth locking member 45 is rotated and moved toward the drive head 22, the first receiving portion 451 pushes the third locking member 43 which compresses the third elastic member 44, and the third locking portion 431 is detached from the second locking portion 422, so that the second locking member 42 is unlocked from and not limited by the first locking member 41, and the locking set 40 is disposed at the unlocked state. Thus, the first body set 10 and the second body set 20 are disposed at the pivoting state. When the first body set 10 is rotated and moved relative to the second body set 20, the first locking member 41 is driven and moved by the first body set 10, to push the third body 47, so that the third body 47 is moved to press the elastic member set 30 so as to adjust the torque of the torque structure. When the fourth locking member 45 is rotated and moved opposite to the drive head 22, the third locking member 43 is released from the first receiving portion 451 and pushed by the restoring force of the third elastic member 44, so that the third locking portion 431 is moved to intermesh with the first locking portion 412 and the second locking portion 422. In such a manner, the second locking member 42 is locked and limited by the first locking member 41 and the third locking member 43 and cannot be rotated, so that the locking set 40 is disposed at the locked state, and the first body set 10 and the second body set 20 are disposed at the non-pivoting state. Thus, the first body set 10 is secured to and cannot be moved relative to the second body set 20.

When the locking set 40 is disposed at the locked state, the second abutting portion 456 rests on the second receiving portion 463. When the locking set 40 is disposed at the unlocked state, the second abutting portion 456 is detached from the second receiving portion 463.

The torque structure further comprises a fastening (or connecting) member 50 connected with the fifth screwed portion 421 and abutting the first body 11, so that the locking set 40 is restricted by fastening member 50 and cannot be removed from the first receiving recess 111.

Figure 15:
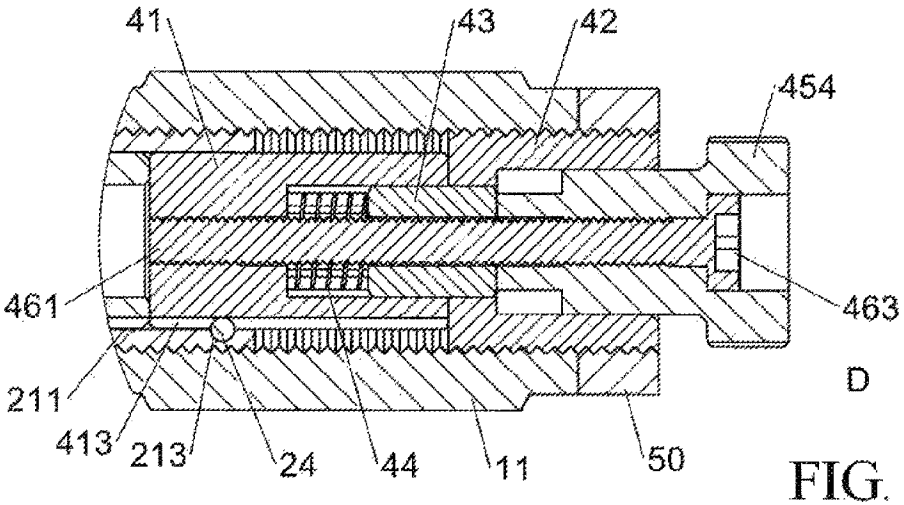
FIG. 15 is a locally enlarged view of the torque structure taken along circle D as shown in FIG. 14.

Referring to FIGS. 12-15 with reference to FIGS. 1-11, the second body set 20 is assembled with the first body set 10. The elastic member set 30 is received in the third receiving recess 211. The locking set 40 is assembled with the first body set 10 and the second body set 20. The locking set 40 is driven to control operation of the first body set 10 and the second body set 20. When the rotation portion 454 is rotated, the second threaded portion 453 is rotated and moved on the fourth threaded portion 462, so that the fourth locking member 45 is rotated and moved in the first receiving chamber 423. When the fourth locking member 45 is rotated and moved opposite to the drive head 22, the third locking member 43 is released from the first receiving portion 451 and pushed by the restoring force of the third elastic member 44, so that the third locking portion 431 is moved to intermesh with the first locking portion 412 and the second locking portion 422. In such a manner, the second locking member 42 is locked and limited by the first locking member 41 and the third locking member 43 and cannot be rotated as shown in FIG. 15, so that the locking set 40 is disposed at the locked state, and the first body set 10 and the second body set 20 are disposed at the non-pivoting state. Thus, the first body set 10 is secured to and cannot be moved relative to the second body set 20.

Figure 16:
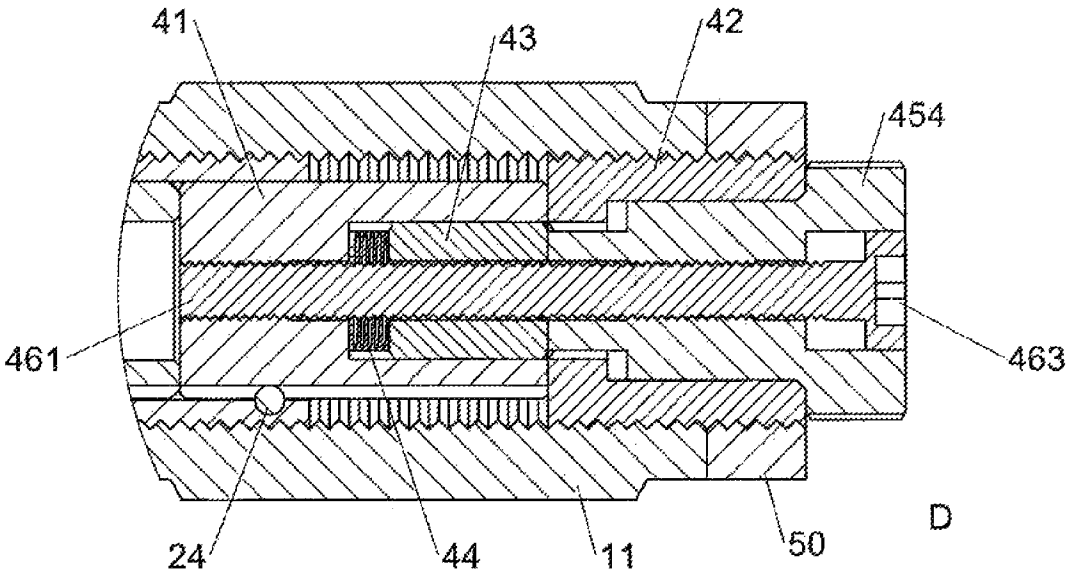
FIG. 16 is a schematic operational view of the torque structure as shown in FIG. 15.
Figure 17:
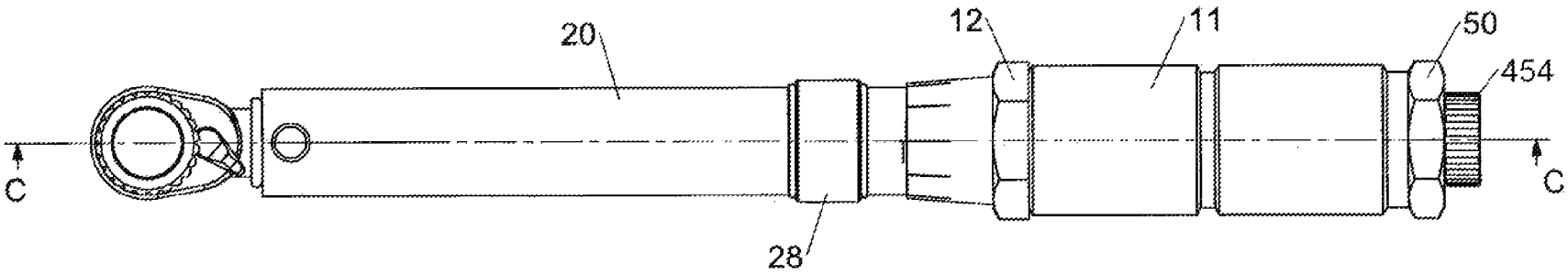
FIG. 17 is a schematic operational view of the torque structure as shown in FIG. 13.
Figure 18:
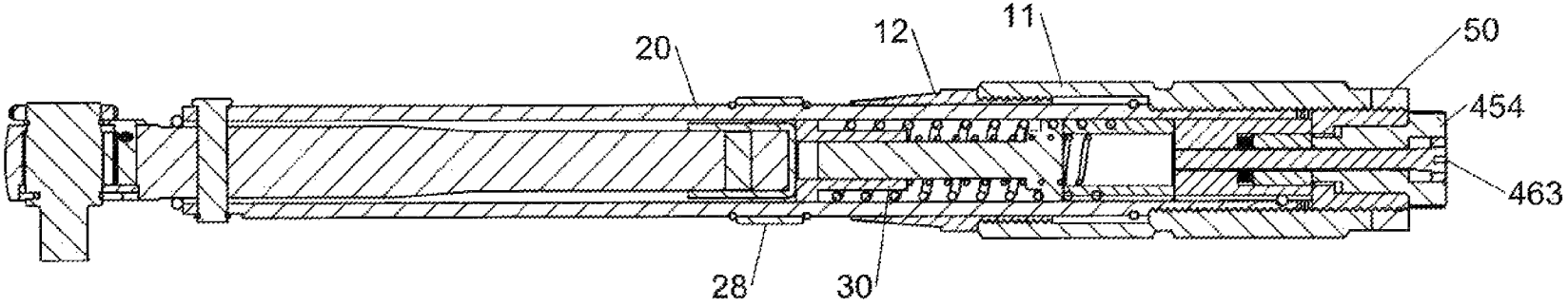
FIG. 18 is a cross-sectional view of the torque structure taken along line C-C as shown in FIG. 17.
Figure 19:
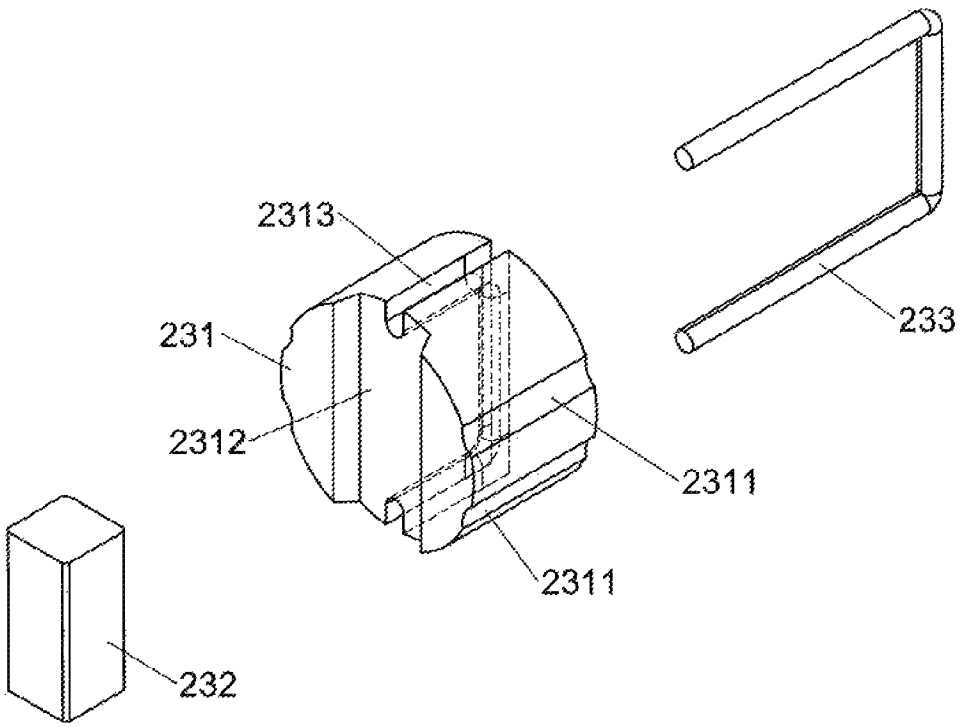
FIG. 19 is an exploded perspective view of a resisting module of the torque structure in accordance with the preferred embodiment of the present invention.

Referring to FIGS. 16-18 with reference to FIGS. 1-15, when the fourth locking member 45 is rotated and moved toward the drive head 22, the first receiving portion 451 pushes the third locking member 43 and compresses the third elastic member 44, and the third locking portion 431 is detached from the second locking portion 422, so that the second locking member 42 is unlocked from and not limited by the first locking member 41 and the third locking member 43 as shown in FIG. 16, and the locking set 40 is disposed at the unlocked state. Thus, the first body set 10 and the second body set 20 are disposed at the pivoting state, and the first body set 10 can be rotated and moved relative to the second body set 20. In such a manner, when the first body set 10 is rotated and moved relative to the second body set 20, the second locking member 42 is rotated by and moved with the first body 11 by engagement of the fifth screwed portion 421 with the first screwed portion 112, so that the second locking member 42 is rotated and moved relative to the second body set 20 to push the first locking member 41 forward. In such a manner, the first locking member 41 is driven and moved by the first body set 10, to push the third body 47, so that the third body 47 is moved to press the elastic member set 30. Thus, when the first body set 10 is rotated and moved relative to the second body set 20, the locking set 40 is driven and moved to press the elastic member set 30 so as to adjust the torque of the torque structure as shown in FIGS. 17 and 18.

Figure 20:
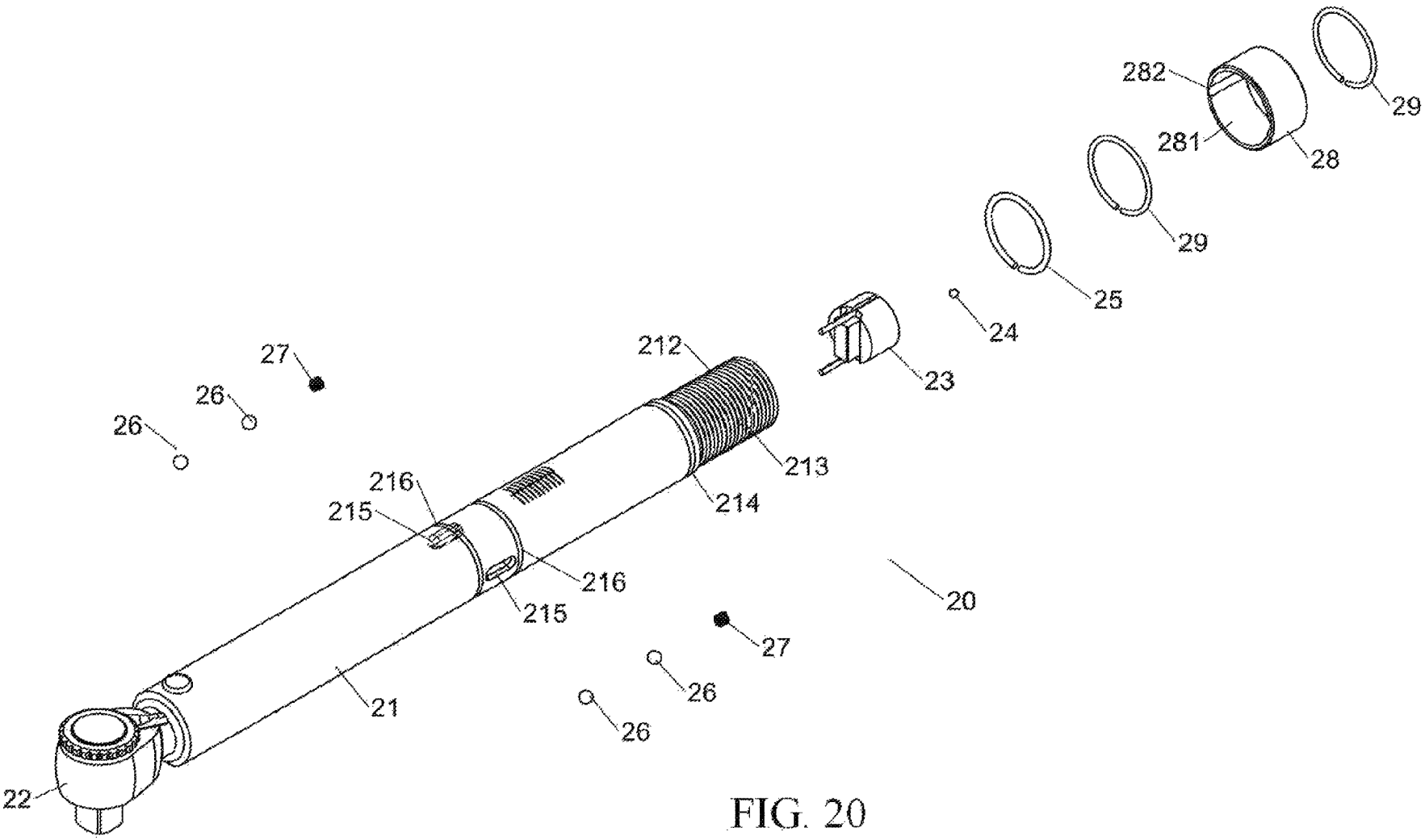
FIG. 20 is an exploded perspective view of a torque structure in accordance with the second preferred embodiment of the present invention.

Referring to FIG. 20, the second body 21 has two ball slots 215 arranged on two opposite sides of the second body 21.

Figure 21:
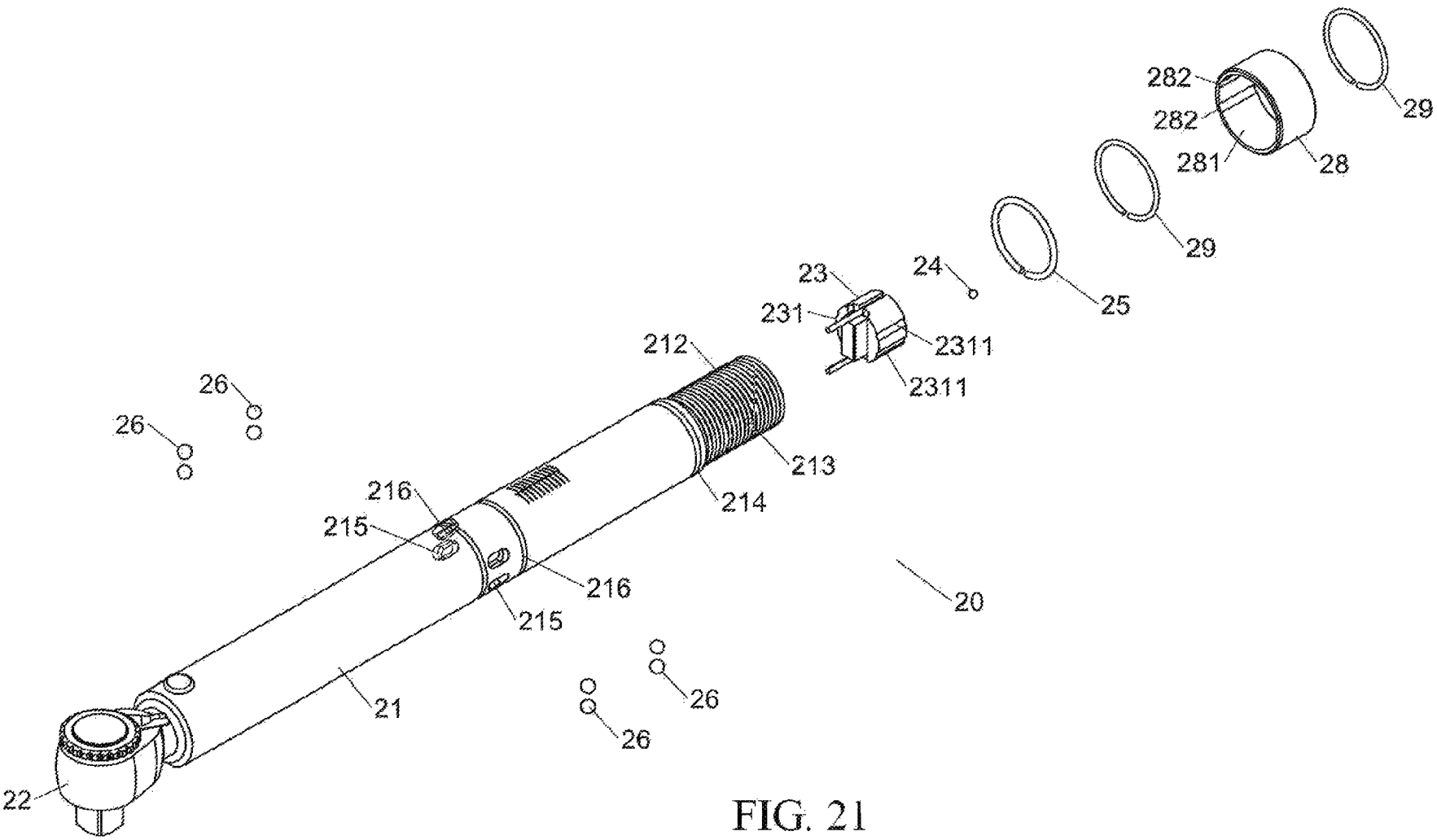
FIG. 21 is an exploded perspective view of a torque structure in accordance with the third preferred embodiment of the present invention.

Referring to FIG. 21, the springs 27 are undefined. Each of the ball slots 215 receives two balls 26.

Figure 22:
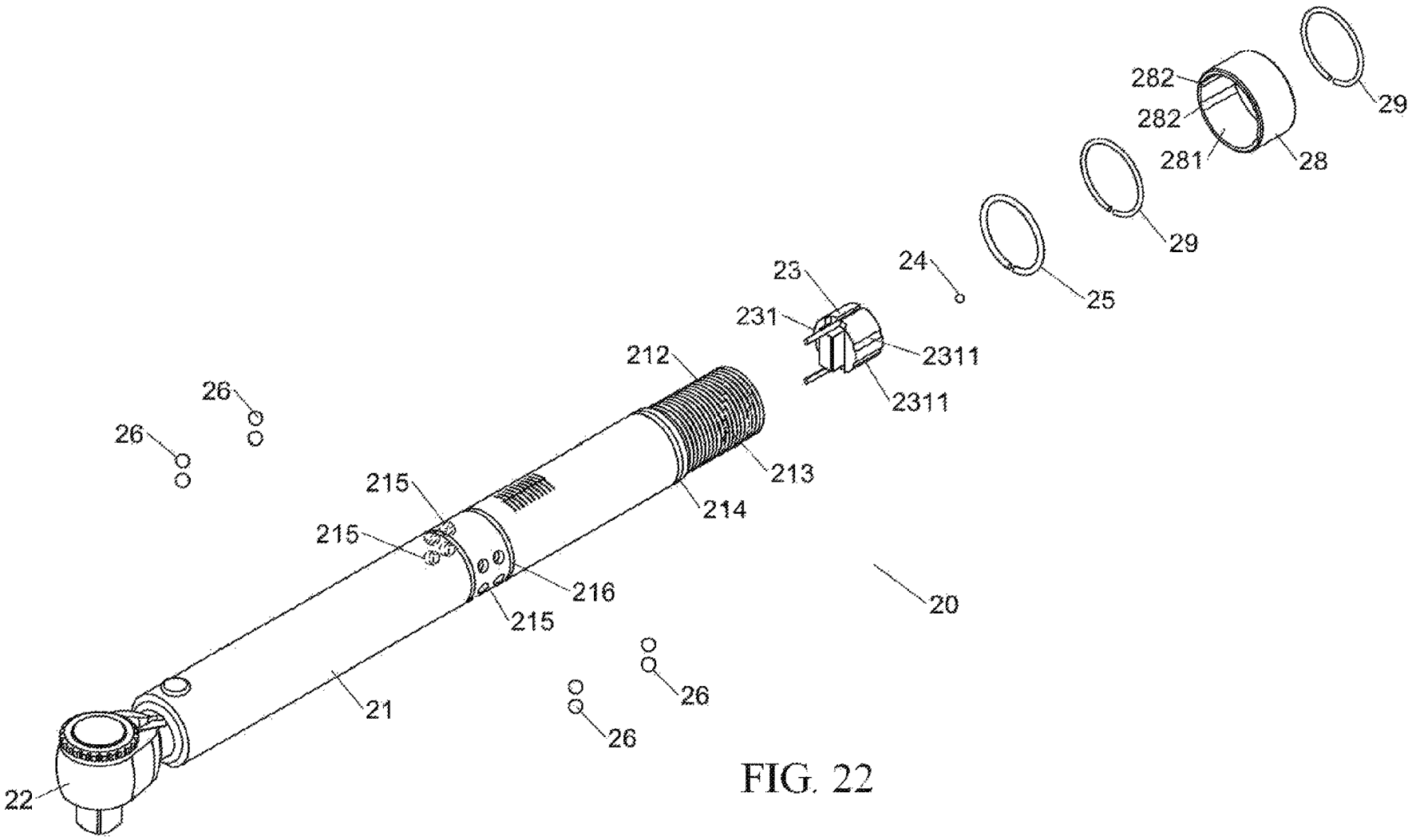
FIG. 22 is an exploded perspective view of a torque structure in accordance with the fourth preferred embodiment of the present invention.

Referring to FIG. 22, each of the ball slots 215 is a circular hole. The second body 21 has eight ball slots 215 that are divided into two pairs arranged symmetrically relative to the second body 21. Each of the two pairs of the eight ball slots 215 has a tetragonal shape and is arranged linearly relative to the axis of the second body 21. Each of the eight ball slots 215 receives one of the balls 26.

In another preferred embodiment of the present invention, the first channels 2311 of the first abutting element 231 are undefined, and the balls 26 directly press the outer face of the first abutting element 231. Similarly, the second channels 282 of the mounting ring 28 are undefined, and the balls 26 directly press the inner face of the fourth receiving recess 281.

In another preferred embodiment of the present invention, the second mounting portion 315 is a noncircular or hexagonal recess, and the fourth mounting portion 324 is a noncircular or hexagonal body.

Accordingly, the torque structure has the following advantages.

1. The mounting ring 28 is mounted on the second body 21 and has a diameter more than that of the second body 21.

The balls 26 protrude from the ball slots 215 and are hidden in the mounting ring 28 so that each of the balls 26 has a larger diameter due to the larger diameter of the mounting ring 28. Thus, when the balls 26 are located between the resisting module 23 and the mounting ring 28, the balls 26 have better antifriction rolling effect when the resisting module 23 is moved in the third receiving recess 211.

2. The second body 21 is not worked by a heat treatment and has a weak strength. The mounting ring 28 has a strong strength so that the mounting ring 28 is mounted on the second body 21 to support and enhance the strength of the second body 21.

Figure 5:
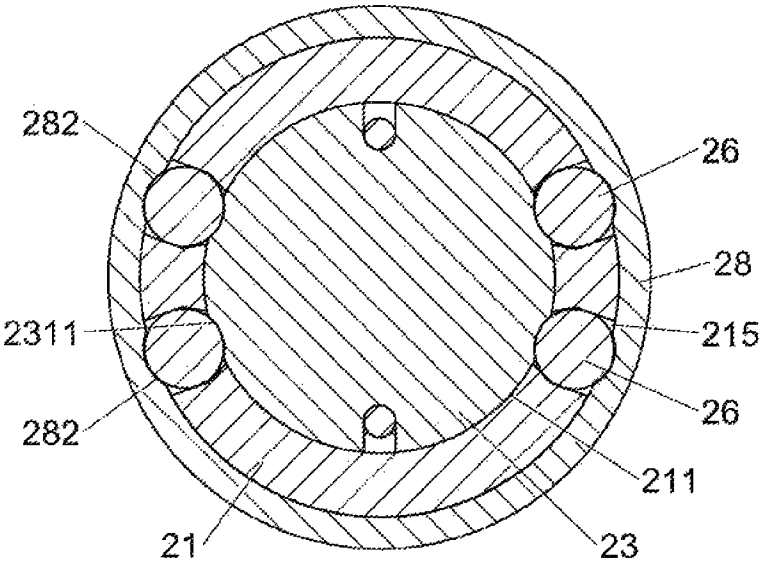
FIG. 5 is a cross-sectional view of the second body set taken along line A-A as shown in FIG. 4.
Figure 6:
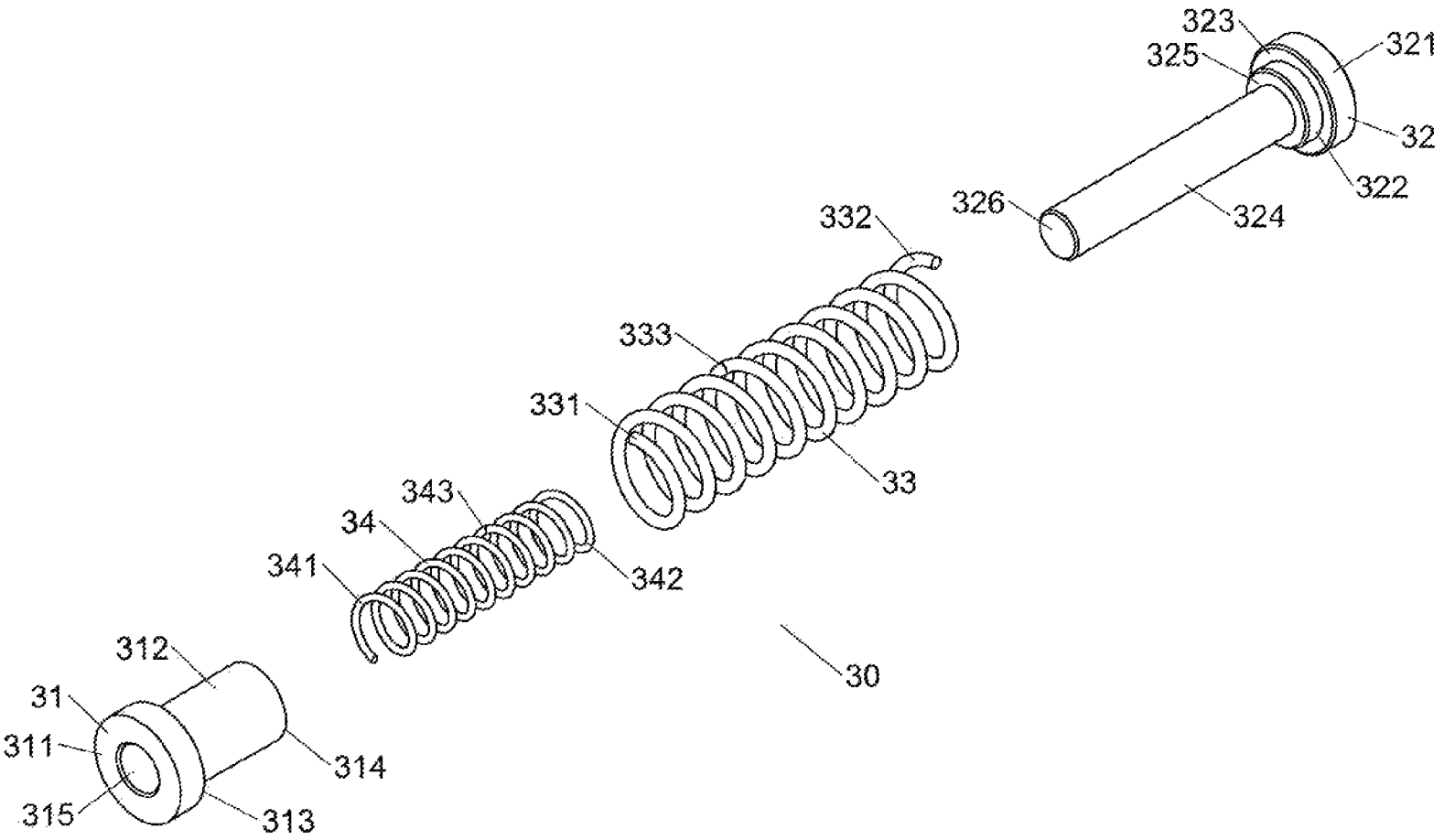
FIG. 6 is an exploded perspective view of an elastic member set of the torque structure in accordance with the preferred embodiment of the present invention.
Figure 7:
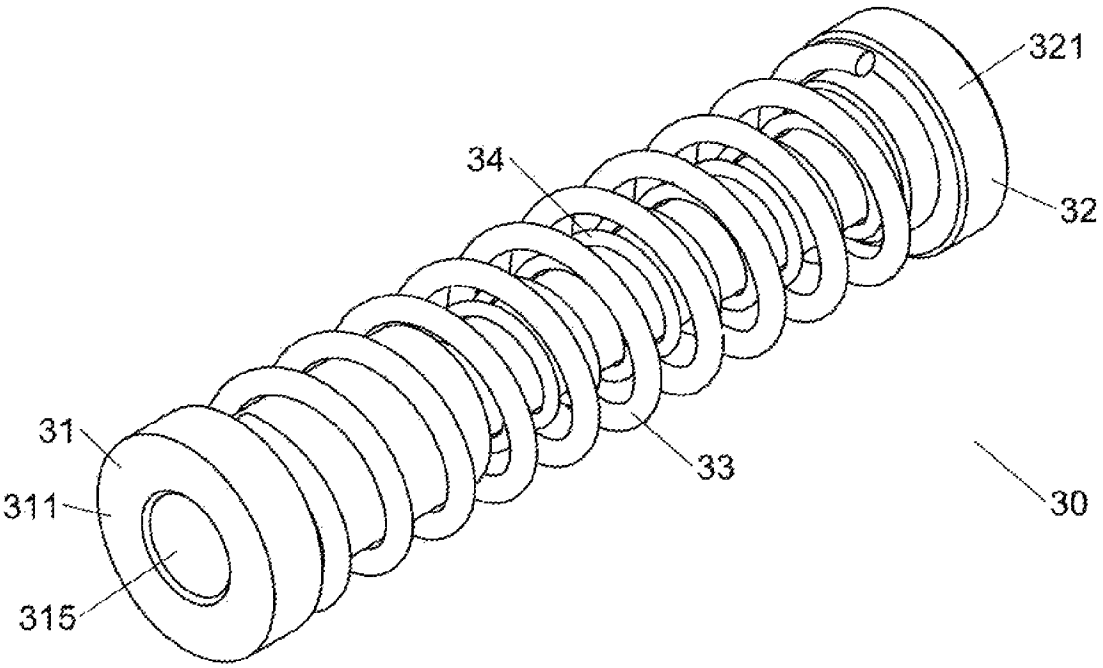
FIG. 7 is a perspective assembly view of the elastic member set as shown in FIG. 6.

3. As shown in FIG. 5, the balls 26 are received in the ball slots 215 and pressed between the resisting module 23 and the mounting ring 28. The second body 21, the resisting module 23, the balls 26, and the mounting ring 28 construct a bearing device, so that the balls 26 have better rolling effect.

4. The resisting module 23 is placed into the third receiving recess 211, the balls 26 are then received in the ball slots 215, and the mounting ring 28 is then mounted on the second body 21, so that the balls 26 are assembled easily and conveniently.

Figure 2:
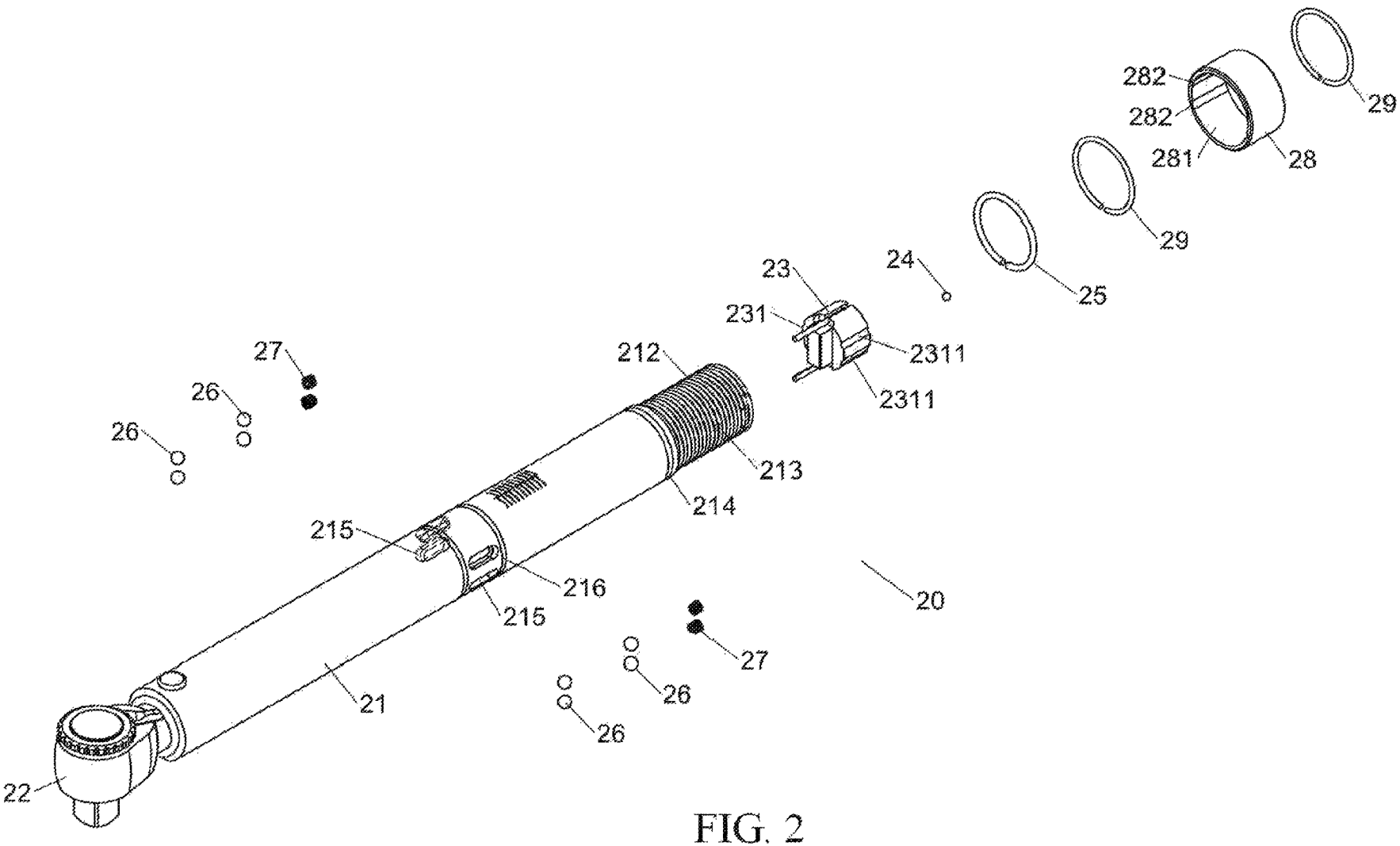
FIG. 2 is an exploded perspective view of a second body set of the torque structure in accordance with the preferred embodiment of the present invention.
Figure 3:
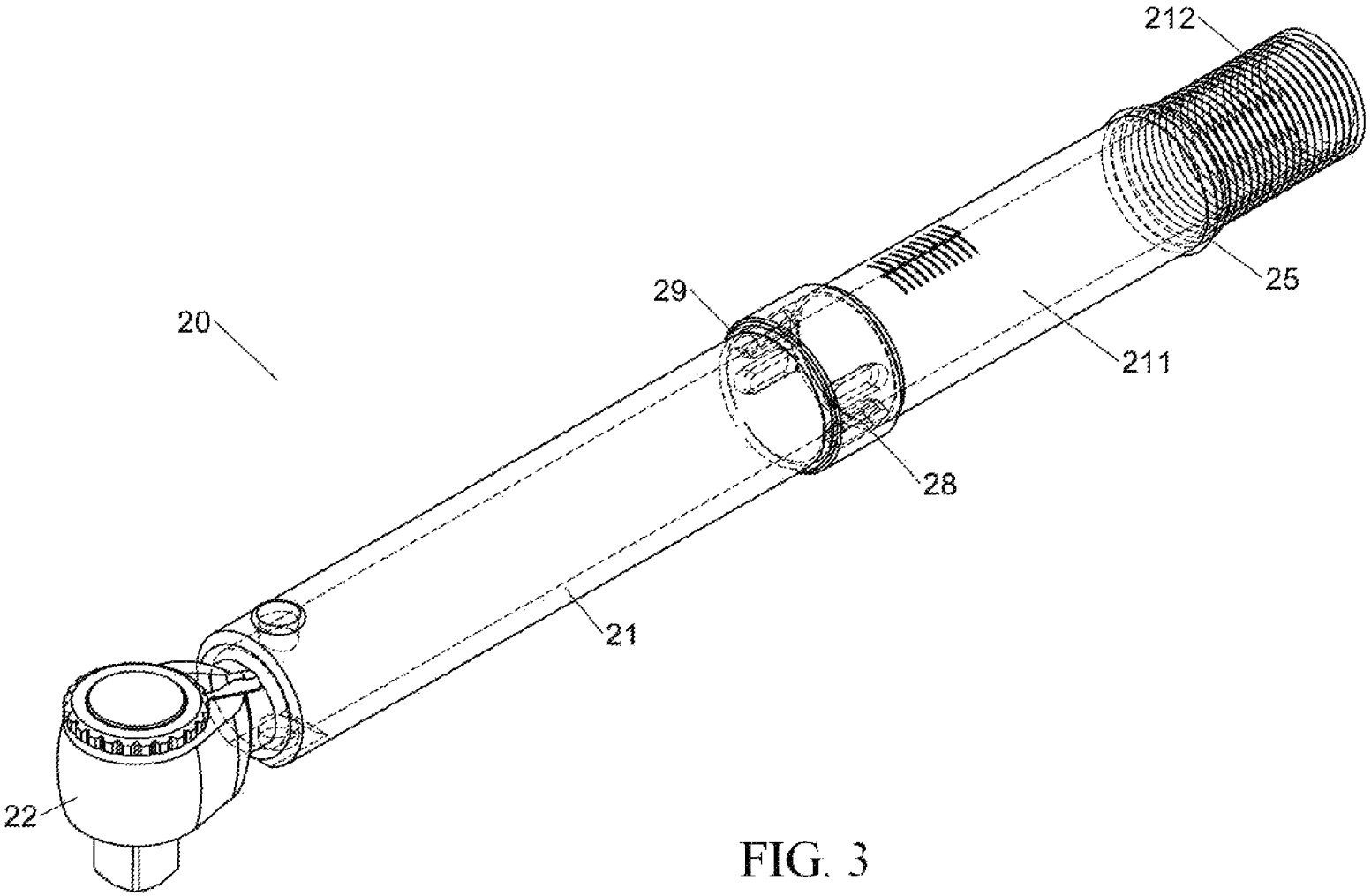
FIG. 3 is a perspective assembly view of the second body set as shown in FIG. 2.
Figure 4:
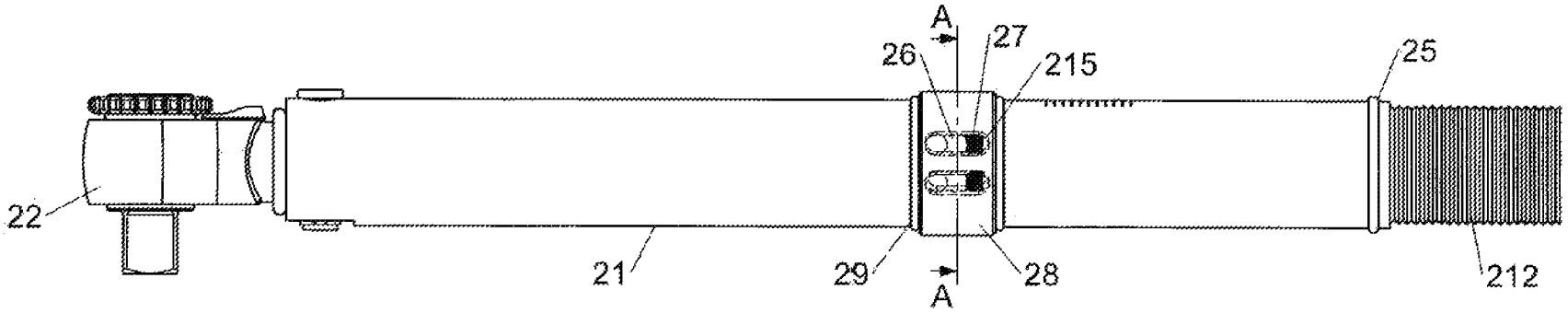
FIG. 4 is a side view of the second body set as shown in FIG. 3.

5. As shown in FIGS. 2 and 5, the balls 26 are located between the first channels 2311 and the second channels 282, and a linear contact structure is defined between the balls 26, the first channels 2311, and the second channels 282, so that a larger contact area is defined between the resisting module 23, the balls 26, and the mounting ring 28, thereby enhancing the rolling effect of the balls 26 when the resisting module 23 is moved in the third receiving recess 211.

6. The mounting ring 28 has larger diameter so that each of the first channels 2311 has smaller depth, and more balls 26 are mounted in the first channels 2311 and the ball slots 215, thereby enhancing the rolling effect.

7. As shown in FIG. 9, the first push member 31 is mounted on the second push member 32, the first elastic member 33 is biased between the first resting edge 313 and the third resting edge 323, and the second elastic member 34 is received in the first elastic member 33 and biased between the second resting edge 314 and the fourth resting edge 325. Thus, the first push member 31 and the second push member 32 support the first elastic member 33 and the second elastic member 34 so that the first elastic member 33 and the second elastic member 34 will not be bent and flexed easily.

8. The first elastic member 33 and the second elastic member 34 have two different maximum diameter values so that the elastic torque of the elastic member set 30 is changed gradually, and the torque value of the torque structure is easily adjusted during fabrication in the factory.

9. The second diameter differential 343 of the second elastic member 34 is different from the first diameter differential 333 of the first elastic member 33 so that the elastic torque of the elastic member set 30 is varied gradually, and the torque value of the torque structure is easily adjusted during fabrication in the factory.

10. The fourth mounting portion 324 is mounted in the second mounting portion 315, and the first elastic member 33 is mounted on the first mounting portion 312 and the third mounting portion 322. Thus, a mounting structure is defined between the first push member 31 and the second push member 32, between the first push member 31 and the first elastic member 33 and between the second push member 32 and the first elastic member 33, so that the first push member 31, the second push member 32, and the first elastic member 33 are assembled exactly.

11. The fourth mounting portion 324 is moved in the second mounting portion 315 during displacement of the second push member 32 to guide movement of the second push member 32 exactly.

12. When the second push member 32 is driven and moved, the fourth mounting portion 324 is moved in the second mounting portion 315, the third resting edge 323 presses the second elastic portion 332, and the fourth resting edge 325 presses the fourth elastic portion 342, to adjust the length of the first elastic member 33 and the second elastic member 34, and to adjust the torque value of the torque structure.

13. The first push member 31 is mounted on the second push member 32, the fourth mounting portion 324 is mounted in the second mounting portion 315, the first elastic member 33 is mounted on the first mounting portion 312, the third mounting portion 322, and the fourth mounting portion 324, the second elastic member 34 is mounted on the fourth mounting portion 324 and is received in the first elastic member 33, so that the first push member 31, the second push member 32, the first elastic member 33, and the second elastic member 34 are interconnected to enhance the structural strength.

14. The locking set 40 is switched between an unlocked state wherein the first body set 10 and the second body set 20 are disposed at a pivoting state, and a locked state wherein the first body set 10 and the second body set 20 are disposed at a non-pivoting state. The locking set 40 directly or indirectly presses the elastic member set 30. When the locking set 40 is disposed at the unlocked state, the first body set 10 is rotated and moved relative to the second body set 20, and drives and moves the locking set 40 simultaneously, so that the locking set 40 is moved to adjust the length of the elastic member set 30 so as to adjust the torque of the torque structure.

15. The second locking member 42 is combined with the first body 11, the third locking member 43 is movable between the first locking member 41 and the second locking member 42, and the third locking portion 431 constantly meshes with the first locking portion 412, and releasably meshes with the second locking portion 422. When the third locking portion 431 meshes with the second locking portion 422, the second locking member 42 is locked by the first locking member 41 and the third locking member 43 and cannot be rotated. When the third locking portion 431 is released from the second locking portion 422, the first locking member 41 is rotatable, and the first body set 10 can be rotated and moved.

16. When the first body set 10 and the second body set 20 are disposed at the non-pivoting state, the locking set 40 has to withstand the external force. The whole outer face of the third locking portion 431 meshes with the first locking portion 412 and the second locking portion 422 fully and completely to provide a better support for bearing the external force.

17. The fourth locking member 45 is rotated and moved to directly drive and move the third locking member 43 so that the locking set 40 is switched between the locked state and the unlocked state exactly.

18. When the rotation portion 454 is rotated, the second threaded portion 453 is rotated and moved on the fourth threaded portion 462, so that the fourth locking member 45 is rotated and moved in the first receiving chamber 423, the first receiving portion 451 pushes the third locking member 43, so that the third locking portion 431 meshes with or is detached from the second locking portion 422.

19. When the fourth locking member 45 is rotated and moved opposite to the drive head 22, the third elastic member 44 is biased between the first locking member 41 and the third locking member 43, so that the third locking portion 431 is moved to intermesh with the first locking portion 412 and the second locking portion 422. In such a manner, the second locking member 42 is locked and limited by the first locking member 41 and the third locking member 43 and cannot be rotated, so that the locking set 40 is disposed at the locked state as shown in FIG. 15, and the first body set 10 and the second body set 20 are disposed at the non-pivoting state. Thus, the first body set 10 is secured to and cannot be moved relative to the second body set 20 so that the torque cannot be adjusted.

20. When the fourth locking member 45 is rotated and moved toward the drive head 22, the first receiving portion 451 pushes the third locking member 43 which compresses the third elastic member 44, and the third locking portion 431 is detached from the second locking portion 422, so that the second locking member 42 is unlocked from and not limited by the first locking member 41, and the locking set 40 is disposed at the unlocked state as shown in FIG. 16. Thus, the first body set 10 and the second body set 20 are disposed at the pivoting state. When the first body set 10 is rotated and moved relative to the second body set 20, the locking set 40 is driven and moved, so that the first locking member 41 is driven by the first body set 10 and moved in the first receiving recess 111 and the third receiving recess 211, to push the third body 47. Thus, the third body 47 is moved to press the elastic member set 30 so as to adjust the torque of the torque structure. The fourth threaded portion 462 is screwed with the second threaded portion 453 so that the fourth locking member 45 is located at the locked position exactly. Thus, the user's hand does not need to hold the fourth locking member 45 when rotating the first body set 10.

21. The first ring 25 is mounted in the first annular groove 214 and aligns with the first abutting portion 123. When the first body set 10 is rotated and moved relative to the second body set 20, the first abutting portion 123 is restricted by the first ring 25 so that the first body set 10 cannot be detached from the second body set 20. When the first body set 10 is rotated and moved to a position where the first abutting portion 123 rests on the first ring 25, the torque value of the torque structure approaches the minimum. Thus, the first body set 10 cannot be rotated and moved opposite to the drive head 22, to prevent the first body set 10 from being detached from the second body set 20.

22. When the fourth locking member 45 is rotated and moved toward the drive head 22, the second abutting portion 456 is limited by the second receiving portion 463, to prevent the fourth locking member 45 from being detached from the second locking member 42, thereby providing a safety function.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the scope of the invention.

The invention claimed is:

1. A torque structure comprising:

a first body set, a second body set, and an elastic member set;

wherein:

the first body set includes a first body and a fitting member;

the first body has an interior provided with a first receiving recess;

the first receiving recess has a circular shape and extends through the first body;

the first receiving recess has a first end provided with a first screwed portion and a second end provided with a second screwed portion;

each of the first screwed portion and the second screwed portion is an internal thread;

the second screwed portion has a diameter more than that of the first screwed portion;

the fitting member is assembled with the first body;

the fitting member has a peripheral face provided with a third screwed portion screwed with the second screwed portion;

the third screwed portion is an external thread;

the fitting member has an interior provided with a second receiving recess having a circular shape and extending through the fitting member;

the second receiving recess is connected to the first receiving recess;

the third screwed portion is provided with a first abutting portion hidden in the first receiving recess;

the second body set is assembled or connected with the first body set;

the second body set includes a second body, a drive head, a resisting module, a restriction member, a first ring, a plurality of balls, a mounting ring, and two second rings;

the second body is partially received in the first receiving recess and extends through the second receiving recess;

the second body has an interior provided with a third receiving recess having a circular shape;

the third receiving recess is connected to the first receiving recess;

the second body has a first end provided with a fourth screwed portion screwed with the first screwed portion;

the fourth screwed portion is an external thread;

the first screwed portion is rotated and moved on the fourth screwed portion so that the first body set is rotated and moved relative to the second body;

the second body has an inner face provided with a first limit groove connected to the third receiving recess;

the second body is provided with a first annular groove hidden in the first receiving recess;

the second body is provided with a plurality of ball slots connected to the third receiving recess;

the second body is provided with two second annular grooves;

the ball slots are arranged between the two second annular grooves;

the drive head is connected with a second end of the second body;

the resisting module is received in the third receiving recess and includes a first abutting element;

the first abutting element is provided with a plurality of first channels aligning with the ball slots;

the restriction member is received in the first limit groove and partially protrudes from the third receiving recess;

the restriction member has a ball shape;

the first ring is mounted in and partially protrudes from the first annular groove;

the first ring aligns with the first abutting portion;

when the first body set is rotated and moved relative to the second body set, the first abutting portion is restricted by the first ring;

the balls are received in the ball slots;

the balls partially extend into the first channels and partially protrude from the second body;

the mounting ring is mounted on the second body and has an interior provided with a fourth receiving recess allowing passage of the second body;

the ball slots are hidden in the fourth receiving recess;

the fourth receiving recess has an inner face provided with a plurality of second channels aligning with the ball slots;

the balls are located between the first channels and the second channels;

a linear contact structure is defined between the balls, the first channels, and the second channels;

the two second rings are mounted in and partially protrude from the two second annular grooves;

the mounting ring is located between the two second rings;

the elastic member set is received in the third receiving recess and pushes the resisting module;

the elastic member set includes a first push member, a second push member, a first elastic member, and a second elastic member;

the first push member has a first end provided with a first head and a second end provided with a first mounting portion;

the first head has a circular shape and pushes the resisting module;

the first mounting portion has a circular shape with a diameter less than that of the first head;

the first push member has a first resting edge formed between the first head and the first mounting portion;

the first mounting portion has an end provided with a second resting edge;

the first push member has an interior provided with a second mounting portion;

the second push member has an end provided with a second head having a circular shape;

the second head has an end provided with a third mounting portion having a circular shape with a diameter less than that of the second head;

the second push member has a third resting edge formed between the second head and the third mounting portion;

the third mounting portion is provided with a fourth mounting portion having a diameter less than that of the third mounting portion;

the second push member has a fourth resting edge formed between the third mounting portion and the fourth mounting portion;

the fourth mounting portion has a first end received in the second mounting portion;

the first elastic member is biased between the first push member and the second push member and is mounted on the first mounting portion, the third mounting portion, and the fourth mounting portion;

the first elastic member has a first end provided with a first elastic portion abutting the first resting edge and a second end provided with a second elastic portion abutting the third resting edge;

the first elastic member has a first diameter differential that is a difference between the maximum diameter and the minimum diameter of the first elastic member;

the second elastic member is biased between the first push member and the second push member and is received in the first elastic member;

the second elastic member is mounted on the fourth mounting portion and has a first end provided with a third elastic portion abutting the second resting edge and a second end provided with a fourth elastic portion abutting the fourth resting edge;

the second elastic member has a second diameter differential that is a difference between the maximum diameter and the minimum diameter of the second elastic member;

the second diameter differential is less than the first diameter differential; and when the second push member is driven and moved relative to the first push member, the fourth mounting portion is moved in the second mounting portion.

2. The torque structure as claimed in claim 1, wherein each of the ball slots has an elongate shape, and the first annular groove is arranged between the fourth screwed portion and the ball slots.

3. The torque structure as claimed in claim 1, wherein the drive head is a ratchet wrench structure with square head.

4. The torque structure as claimed in claim 1, wherein:

the first abutting element is provided with a first receiving groove and a second receiving groove;

the second receiving groove is arranged between the first channels;

the second receiving groove has an inverted U-shaped profile and has two ends connected to the first receiving groove;

the resisting module further includes a second abutting element movably mounted in the first receiving groove, and a third abutting element received in the second receiving groove and having two ends extending into the first receiving groove;

the second abutting element is restricted by the two ends of the third abutting element; and the third abutting element has an inverted U-shaped profile.

5. The torque structure as claimed in claim 1, wherein each of the ball slots receives two of the balls.

6. The torque structure as claimed in claim 1, wherein each of the ball slots has a conic section connected to the third receiving recess.

7. The torque structure as claimed in claim 1, wherein the second body set further includes a plurality of springs received in the ball slots, and the springs are biased between the ball slots and the balls.

8. The torque structure as claimed in claim 1, further comprising:

a locking set assembled with the first body set and the second body set;

wherein:

the locking set is changed between an unlocked state wherein the first body set and the second body set are disposed at a pivoting state, and a locked state wherein the first body set and the second body set are disposed at a non-pivoting state;

the locking set presses the elastic member set;

when the locking set is disposed at the unlocked state, the first body set is rotated and moved relative to the second body set, and drives and moves the locking set simultaneously;

the locking set includes a first locking member, a second locking member, a third locking member, a third elastic member, a fourth locking member, a screw member, and a third body;

the first locking member is received in the first receiving recess and the third receiving recess and has a first end provided with a first threaded portion and a second end provided with a first locking portion connected to the first threaded portion;

the first threaded portion is an internal thread;

the first locking member has an exterior provided with a second limit groove aligning with the first limit groove;

the second limit groove extends in a lengthwise direction of the first locking member;

the restriction member is received in between the first limit groove and the second limit groove;

the first locking member is limited by the restriction member and is moved linearly;

the second locking member is combined with the first body and rests on the first locking member;

the second locking member has a peripheral face provided with a fifth screwed portion screwed with the first screwed portion;

the fifth screwed portion is an external thread and partially protrudes from the first body;

the second locking member is rotated and moved with the first body set;

the second locking member has a first end provided with a second locking portion and a second end provided with a first receiving chamber;

the first receiving chamber is a circular recess connected to the second locking portion;

the third locking member extends through and is movable in the first locking member and the second locking member;

the third locking member has a peripheral face provided with a third locking portion locked in and meshing with the first locking portion and the second locking portion;

the third locking member has an interior provided with a first passage having a circular shape;

the third elastic member is received in the first locking portion and biased between the first locking portion and the third locking member;

the fourth locking member is mounted on the second locking member and has a first end provided with a first receiving portion and a second end provided with a rotation portion;

the first receiving portion is received in the first receiving chamber and rests on the third locking member;

when the fourth locking member is moved in the first receiving chamber, the first receiving portion pushes the third locking member, so that the third locking member is moved in the first locking portion and the second locking portion;

the first receiving portion has an interior provided with a second passage;

the second passage has a circular shape and is provided with a second threaded portion that is an internal thread;

the rotation portion protrudes from the first body;

the rotation portion has an interior provided with a second receiving chamber connected to the second passage;

the second receiving chamber has a diameter more than that of the second passage;

the second receiving chamber is provided with a second abutting portion;

the screw member has a first end provided with a third threaded portion and a fourth threaded portion and a second end provided with a second receiving portion;

the third threaded portion is screwed with the first threaded portion;

the fourth threaded portion passes the first passage and the second passage and is screwed with the second threaded portion;

when the rotation portion is rotated, the second threaded portion is rotated and moved on the fourth threaded portion, so that the fourth locking member is rotated and moved in the first receiving chamber;

each of the third threaded portion and the fourth threaded portion is an external thread;

the second receiving portion is received in the second receiving chamber;

the second abutting portion is moved to contact the second receiving portion;

the fourth threaded portion is arranged between the third threaded portion and the second receiving portion;

the fourth locking member is restricted by the second receiving portion;

the third body is received in the third receiving recess and located between the second push member of the elastic member set and the first locking member;

when the first locking member is moved to push the third body, the third body presses the second push member of the elastic member set;

when the fourth locking member is rotated and moved toward the drive head, the first receiving portion pushes the third locking member which compresses the third elastic member, and the third locking portion is detached from the second locking portion, so that the second locking member is unlocked from the first locking member, and the locking set is disposed at the unlocked state;

when the first body set is rotated and moved relative to the second body set, the first locking member is driven and moved by the first body set, to push the third body, so that the third body is moved to press the elastic member set;

when the fourth locking member is rotated and moved opposite to the drive head, the third locking member is released from the first receiving portion and pushed by the third elastic member, so that the third locking portion is moved to intermesh with the first locking portion and the second locking portion;

the second locking member is locked and limited by the first locking member and the third locking member, so that the locking set is disposed at the locked state;

when the locking set is disposed at the locked state, the second abutting portion rests on the second receiving portion;

when the locking set is disposed at the unlocked state, the second abutting portion is detached from the second receiving portion;

the torque structure further comprises a fastening member connected with the fifth screwed portion and abutting the first body.

9. The torque structure as claimed in claim 1, wherein the second body has two ball slots arranged on two opposite sides of the second body.

10. The torque structure as claimed in claim 1, wherein:

each of the ball slots is a circular hole;

the second body has eight ball slots that are divided into two pairs arranged symmetrically relative to the second body;

each of the two pairs of the eight ball slots has a tetragonal shape and is arranged linearly relative to the axis of the second body; and each of the eight ball slots receives one of the balls.

* * * * *